US008368014B2

(12) United States Patent
Taniguchi

(10) Patent No.: US 8,368,014 B2
(45) Date of Patent: Feb. 5, 2013

(54) ION TRAP TIME-OF-FLIGHT MASS SPECTROMETER

(75) Inventor: Junichi Taniguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/310,377

(22) Filed: Dec. 2, 2011

(65) Prior Publication Data

US 2012/0138788 A1 Jun. 7, 2012

(30) Foreign Application Priority Data

Dec. 7, 2010 (JP) ..... 2010-272205

(51) Int. Cl.
*H01J 49/40* (2006.01)
*H01J 49/42* (2006.01)

(52) U.S. Cl. ..... 250/292; 250/287; 250/290; 250/293; 250/281; 250/286

(58) Field of Classification Search ..... 250/292, 250/287, 290, 293, 281, 286
See application file for complete search history.

(56) References Cited

U.S. PATENT DOCUMENTS 7,193,207 B1 3/2007 Ding et al. ..... 250/292
8,247,763 B2 * 8/2012 Izumi et al. ..... 250/287
8,288,720 B2 * 10/2012 Taniguchi ..... 250/290
2008/0035842 A1 2/2008 Sudakov et al. ..... 250/287
2012/0292499 A1 * 11/2012 Taniguchi ..... 250/286

FOREIGN PATENT DOCUMENTS

JP 2003-512702 4/2003
JP 2007-524978 8/2007
WO WO 2008/072377 A1 6/2008

OTHER PUBLICATIONS

Osamu Furuhashi et al., "Development of Digital Ion Trap Mass Spectrometer"., Shimadzu Review, Mar. 31, 2006, vol. 62, Nos. 3-4, pp. 141-151.

* cited by examiner

*Primary Examiner* — Nikita Wells
(74) *Attorney, Agent, or Firm* — DLA Piper US LLP

(57) ABSTRACT

A technique for improving the mass-resolving power of an ion trap time-of-flight mass spectrometer is provided. At the final stage of a cooling process before the ejection of ions from an ion trap, the frequency of a rectangular-wave voltage applied to a ring electrode of the ion trap is increased for a few to several cycles. This operation reduces the confining potential depth of the ion trap and decelerates the captured ions. The turn-around time of the ions is shortened when the rectangular-wave voltage is halted and an accelerating electric field is created. Thus, the variation in the time of flight of the ions with the same mass-to-charge ratio is reduced. The time for increasing the frequency is determined so that a spread of the ions because of the depth reduction of the confining potential will fall within the range that can be corrected in the time-of-flight mass spectrometer.

14 Claims, 5 Drawing Sheets

PRESENT INVENTION

PRIOR ART: 500kHz CONSTANT

PRESENT INVENTION: 500kHz→700kHz

ION TRAP TIME-OF-FLIGHT MASS SPECTROMETER

TECHNICAL FIELD

The present invention relates to an ion trap time-of-flight mass spectrometer including an ion trap for capturing and storing ions by an electric field and a time-of-flight mass spectrometer in which the ions ejected from the ion trap are separated and detected according to their mass to-charge ratio. More specifically, it relates to an ion trap time-of-flight mass spectrometer using a "digital ion trap", i.e. a type of ion trap which uses a rectangular-wave voltage as the radio-frequency voltage for capturing ions. The ion trap time-of-flight mass spectrometer is hereinafter abbreviated as the "IT-TOFMS."

BACKGROUND ART

The IT-TOFMS has the characteristics of both the ion trap (IT), which is capable of a multi-stage mass spectrometric analysis (an $MS^n$ analysis), and the time-of-flight mass spectrometer (TOFMS), which is capable of performing a mass analysis with high mass-resolving power and high mass accuracy. It has been effectively applied in various fields, particularly in the compositional or structural analysis of high-molecular compounds (e.g. proteins, sugar chains or the like).

There are many types of ion traps, such as the three-dimensional quadrupole type or linear type. In the following description, a three-dimensional quadrupole ion trap having a ring electrode and a pair of end-cap electrodes is taken as one example. In this ion trap, a radio-frequency voltage is applied to the ring electrode in order to capture ions within a space surrounded by the ring electrodes and the end-cap electrodes. To apply the ion-capturing radio-frequency voltage, LC resonance circuits have been conventionally used. In recent years, a new type of device called "digital ion trap" has been developed, which uses a rectangular-wave voltage as the radio-frequency voltage (for example, refer to Patent Documents 1-3 as well as Non-Patent Document 1). As described in Patent Document 1, a digital ion trap includes a drive circuit in which a high direct-current (DC) voltage generated by a DC power source is switched by a high-speed semiconductor switch to generate a rectangular-wave voltage. In principle, this circuit can instantly initiate or halt the application of the voltage with a desired timing (at dramatically higher speeds than the LC resonance circuit).

In the IT-TOFMS, if all the ions to be analyzed are accelerated with the same amount of energy, the ions will fly at different speeds due to the difference in their mass-to-charge ratio and be appropriately separated before arriving at the detector. Therefore, if the ions vary in the amount of energy immediately before the accelerating energy is given, the energy variation will emerge as a difference in the flight speed, which leads to an erroneous result. In an $MS^n$ analysis, this problem is avoided as follows: After a group of ions originating from a sample have been captured in the ion trap, the process of selecting an ion having a specific mass-to-charge ratio and performing collision induced dissociation using the selected ion as the precursor ion is repeated so as to leave a desired kind of ions within the ion trap. Then, the ions maintained in this manner are cooled by collision with a cooling gas (e.g. argon) introduced in the ion trap. As a result of this cooling process, the amount of energy possessed by each ion gradually is attenuated and the ions gather around the center of the ion trap. Subsequently, a direct-current voltage is applied to the end-cap electrodes to create a strong direct-current electric field within the ion trap. This electric field gives an amount of accelerating energy to each ion, whereby the ions are collectively ejected from the ion trap into the TOFMS.

As just described, the ions undergo the cooling process before being ejected from the ion trap. Even during the cooling process, the ions continue oscillating due to the effect of the ion-capturing electric field and become spatially spread to some extent (i.e. they have a spatial distribution). Since the accelerating electric field created by the voltage applied between the two end-cap electrodes has a potential gradient, the amount of potential energy that each ion receives at the moment of ejection depends on the position of the ion. Accordingly, the ions ejected from the ion trap will have a certain amount of energy width.

In the case of the linear type TOFMS, in which the ions are made to fly straight, the aforementioned energy width of the ions having the same mass-to-charge ratio results in a difference in their flight speed and constitutes a factor that lowers the mass-resolving power. By contrast, in the reflectron type TOFMS, the reflectron has the effect of correcting the difference in the potential energy. Though no detailed description will be made in this specification, a well-known type of reflectron, called the "dual-stage reflectron", can correct the second-order aberration of the energy. Even if the amounts of energy of the ions ejected from the ion trap vary within a certain range, the reflectron can correct this variation and temporally focus the ions into an adequately narrow range of time of flight to avoid the decrease in the mass-resolving power.

However, there is another factor that deteriorates the mass-resolving power of the IT-TOFMS; that is, the turn-around time. Suppose there are two ions whose initial velocities are equal in absolute value but have opposite directions immediately before being ejected from the ion trap, with one ion having a velocity component directed toward the TOFMS and the other ion having a velocity component directed away from the TOFMS. When an accelerating electric field for ejecting ions is created, the former ion is immediately accelerated along the downward potential gradient of the accelerating electric field, to be directly sent toward the TOFMS. On the other hand, the latter ion (i.e. the ion having a velocity component directed away from the TOFMS) existing near the center of the ion trap is initially decelerated along the upward potential gradient of the accelerating electric field and then turns to the opposite direction, to be accelerated toward the TOFMS. The period of time $\tau_{TA}$ that passes until this ion once more passes through the center of the ion trap at the initial velocity is called the turn-around time, which is expressed as the following equation:

$$\tau_{TA}=(2v_0m)/(zeE) \quad (1),$$

where $v_0$ is the initial velocity of the ion in the direction away from the TOFMS, m is the mass of the ion, z is the charge number of the ion, e is the elementary charge, and E is the strength of the accelerating electric field at the moment of ejection.

Thus, an ion traveling in the direction away from the TOFMS at the moment of the ejection of the ions will return to the original position after the turn-around time $\tau_{TA}$ and then travel toward the TOFMS at the same initial velocity. The arrival of this ion at the detector will be delayed by the turn-around time $\tau_{TA}$ from that of the ion which travels toward the TOFMS from the beginning. Such a difference in the time of flight due to the turn-around time for the ions having the same mass-to-charge ratio cannot be corrected even by reflectrons. It is also impossible to distinguish between these two ions on the detector. As a result, the mass-resolving power will deteriorate.

With the TOFMS techniques available in recent years, a potential energy having a width of approximately ±10% can be corrected by using an adequately tuned reflectron. Therefor; the turn-around time, which cannot be corrected by reflectrons, is currently the most dominant limiting factor for the improvement of the mass-resolving power in the IT-TOFMS.

BACKGROUND ART DOCUMENT

Patent Docment

Patent Document 1: JP-A 2003-512702

Patent Document 2: JP-A 2007-524978

Patent Document 3: WO-A1 2008/072377

Non-Patent Document

Non-Patent Document 1: Furuhashi, et al. "Dejitaru Ion Torappu shitsuryou Bunseki Souchi No Kaihatsu (Development of Digital Ion Trap Mass Spectrometer)", *Shimadzu Hyouron* (Shimadzu Review), Shimadzu Hyouron Henshuubu, Mar. 31, 2006, Vol. 62, Nos. 3•4, pp. 141-151

DISCLOSURE OF THE INVENTION

Problem to be Solved by the Invention

In the field of mass analysis, there is an increasing demand for an analysis with higher mass accuracy and mass-resolving power to deduce the sample composition with high accuracy for the structural analysis of the sample. The present invention has been developed to meet such a demand. Its objective is to provide an ion trap time-of-flight mass spectrometer whose mass-resolving power is improved by shortening the turn-around time in an ion trap which cannot be corrected by reflectron time-of-flight mass spectrometers.

Means for Solving the Problems

The first aspect of the present invention aimed at solving the aforementioned problem is an ion trap time-of-flight mass spectrometer including an ion trap composed of a plurality of electrodes and a time-of-flight mass spectrometer unit for performing a mass analysis of ions ejected from the ion trap, the mass spectrometer being constructed to temporarily capture ions to be analyzed in the ion trap, subject the ions to a cooling process in which a kinetic energy of the ions is attenuated by making the ions come in contact with a cooling gas, and create an accelerating electric field in the ion trap so as to collectively eject the ions from the ion trap into the time-of-flight mass spectrometer unit and make the ions undergo an analysis, wherein the mass spectrometer further includes:

a) a voltage applier for applying an ion-capturing radio-frequency rectangular-wave voltage to at least one of the electrodes; and b) a controller for operating the voltage applier so as to apply a radio-frequency rectangular-wave voltage to the aforementioned at least one of the electrodes during the cooling process, wherein the controller operates the voltage applier in such a manner that a rectangular-wave voltage having a predetermined frequency and a predetermined amplitude is applied to the aforementioned at least one of the electrodes so as to capture the ions with a potential having a predetermined depth, and then the frequency of the rectangular-wave voltage is increased so as to reduce the depth of the potential for a predetermined period of time immediately before the ions are ejected.

The second aspect of the present invention aimed at solving the aforementioned problem is an ion trap time-of-flight mass spectrometer including an ion trap composed of a plurality of electrodes and a time-of-flight mass spectrometer unit for performing a mass analysis of ions ejected from the ion trap, the mass spectrometer being constructed to temporarily capture ions to be analyzed in the ion trap, subject the ions to a cooling process in which a kinetic energy of the ions is attenuated by making the ions come in contact with a cooling gas, and create an accelerating electric field within the ion trap to collectively eject the ions from the ion trap into the time-of-flight mass spectrometer unit and make the ions undergo an analysis, wherein the mass spectrometer further includes:

a) a voltage applier for applying an ion-capturing radio-frequency rectangular-wave voltage to at least one of the electrodes; and b) a controller for operating the voltage applier so as to apply a radio-frequency rectangular-wave voltage to the aforementioned at least one of the electrodes during the cooling process, wherein the controller operates the voltage applier in such a manner that a rectangular-wave voltage having a predetermined frequency and a predetermined amplitude is applied to the aforementioned at least one of the electrodes so as to capture the ions with a potential having a predetermined depth, and then the amplitude of the rectangular-wave voltage is decreased so as to reduce the depth of the potential for a predetermined period of time immediately before the ions are ejected.

Examples of ion traps available in the ion trap time-of-flight mass spectrometers according to the first and second aspects of the present invention include a three-dimensional quadrupole ion trap and a linear-type ion trap. In the case of the three-dimensional quadrupole ion trap, the "at least one of the electrodes" is the ring electrode.

Examples of time-of-flight mass spectrometer units available in the ion trap time-of-flight mass spectrometers according to the first and second aspects of the present invention include a reflectron time-of-flight mass spectrometer unit or similar type of time-of-flight mass spectrometer unit with an energy-focusing function.

One possible measure for shortening the turn-around time, which is a major factor that lowers the mass-resolving power in the ion trap, is to strengthen the accelerating electric field created for ejecting the ions (i.e. to increase the potential gradient), and another measure is to decelerate the ions immediately before the ejection of the ions. Strengthening the accelerating electric field requires increasing the voltage applied to the electrodes forming the ion trap. However, such an increase in the applied voltage is restricted due to the problem of electric discharge.

As for the deceleration of the ions, there is the option of reducing the depth of the confining potential of the ion trap. According to Non-Patent Document 1 or other documents, the depth Dz of the confining potential well of an ion trap is expressed as the following equation:

$$Dz \propto V^2/\Omega^2 \quad (2).$$

For a three-dimensional quadrupole digital ion trap, Ω is the angular frequency of the rectangular-wave voltage applied to the ring electrode and V is the amplitude of this voltage. Equation (2) suggests that the depth of the confining potential can be reduced by increasing the angular frequency Ω or decreasing the amplitude V of the rectangular-wave voltage. However, if the cooling of the ions is performed under such conditions, the positional distribution of the ions will be too broad and exceed the allowable (correctable) energy width of the TOFMS at the moment of ejection of the ions, causing a deterioration of the mass-resolving power.

Taking this into account, in the ion trap time-of-flight mass spectrometers according to the first and second aspects of the present invention, the frequency and amplitude of the radio-frequency rectangular-wave voltage are appropriately set so as to maintain a deep confining potential, i.e. so as to confine the ions within an adequately small space, over the nearly entire length of the cooling period, after which the depth of the confining potential is reduced by increasing the frequency and/or decreasing the amplitude of the rectangular-wave voltage for a predetermined period of time at the end of the cooling period, i.e. immediately before the ejection of the ions. Reducing the depth of the confining potential decelerates the ions oscillating within the ion trap and thereby shortens the turn-around time of an ion having a velocity component directed away from the TOFMS at the moment of the creation of the accelerating electric field for ejecting the ions. As a result, the variation in the arrival time of the ions having the same mass-to-charge ratio is reduced, so that the mass-resolving power is improved.

Reducing the depth of the confining potential in the ion trap in the previously described manner not only decreases the speed of the ions oscillating within the ion trap; it also increases the spread of the ions since the binding force of the electric field becomes weaker. This spread of the ions leads to a variation in their energy. If this energy variation exceeds the range that can be corrected by TOFMSs, the speed dispersion resulting from the energy variation will be so large that it will significantly affect the mass-resolving power. To address this problem, the period of time for reducing the depth of the potential immediately before the ejection of the ions, i.e. the "predetermined period of time" in the present invention, should preferably be set within a range where the energy variation resulting from the reduction in the depth of the potential remains within a range that can be corrected by a TOFMS.

Accordingly, in one preferable mode of the ion trap time-of-flight mass spectrometers according to the first and second aspects of present invention, the length of the predetermined period of time is set so that the spatial spread of the ions due to the reduction in the depth of the potential will fall within a range that can be corrected by the energy-focusing function of the time-of-flight mass spectrometer unit. This is the upper limit of the length of the predetermined period of time.

The range of the appropriate length of the predetermined period of time depends on not only the energy-focusing capability of the TOFMS but also many factors and conditions. For example, it naturally depends on the amount by which the depth of the confining potential is reduced from the previous level, i.e. the extent of increase in the frequency of the rectangular-wave voltage or decrease in the amplitude thereof. It also depends on the cooling conditions, such as the cooling-gas pressure inside the ion trap, the kind of cooling gas, and the cooling time. Accordingly, it is desirable to experimentally determine an appropriate length of time beforehand under the same conditions as used in the actual analysis.

According to an experimental study by the present inventor, under the condition that the amount of increase in the frequency of the rectangular-wave voltage or decrease in the amplitude thereof is determined so that the depth of the potential will be approximately one half of the previous level, it is preferable to set the predetermined period of time within a temporal range corresponding to approximately one to ten times the cycle of the rectangular-wave voltage. When the predetermined period of time is longer than this range, the effect of decelerating the ions will be barely obtained. Conversely, when the predetermined period of time is shorter than that range, the effect of the improvement in the mass-resolving power due to the deceleration of the ions will be totally cancelled by the effect of the decrease in the mass-resolving power due to the spatial spread of the ions.

The length of the predetermined period of time also depends on the mass-to-charge ratio of the target ion, because an ion having a larger mass is slower in motion. Accordingly, in one preferable mode of the ion trap time-of-flight mass spectrometers according to the first and second aspects of the present invention, the controller changes the length of the predetermined period of time according to the mass-to-charge ratio of an ion to be analyzed. More specifically, the predetermined period of time is set to be longer for an ion having a larger mass-to-charge ratio. Naturally, it is possible to control the amount of the increase in the frequency or the decrease in the amplitude of the rectangular-wave voltage so that the depth of the potential after the change in the rectangular-wave voltage is varied according to the mass-to-charge ratio of the ion of interest.

Effect of the Invention

In the ion trap time-of-flight mass spectrometers according to the first and second aspects of the present invention, the turn-around time at the moment of the ejection of the ions from the ion trap, which is a major cause of the difference in the time of flight between the ions having the same mass-to-charge ratio, is shortened, whereby the mass-resolving power is improved.

BEST MODE FOR CARRYING OUT THE INVENTION

Figure 1:
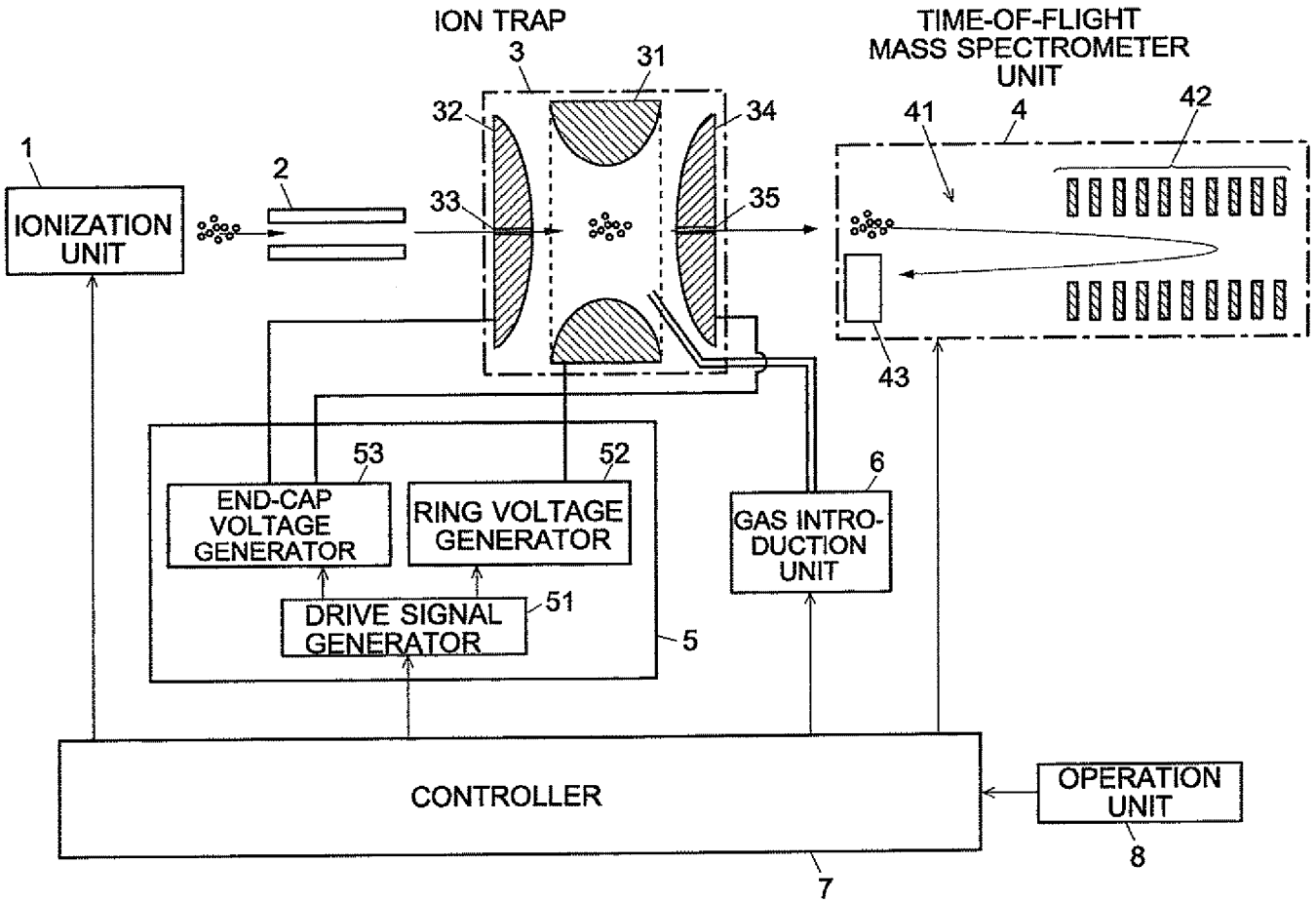
FIG. 1 is an overall configuration diagram of an IT-TOFMS in accordance with one embodiment of the present invention.

An ion trap time-of-flight mass spectrometer (IT-TOFMS) in accordance with one embodiment of the present invention is hereinafter described with reference to the attached drawings. FIG. 1 is a configuration diagram showing the main components of the IT-TOFMS of the present embodiment.

The system shown in FIG. 1 includes an ionization unit 1, an ion guide 2, an ion trap 3, and a time-of-flight mass spectrometer (TOFMS) unit 4, all of which are located in a vacuum chamber (not shown). The ionization unit 1 ionizes a sample component by using a variety of ionization methods. For example, it may use an atmospheric pressure ionization method (e.g. an electrospray ionization method) for liquid samples, an electron ionization method or chemical ionization method for gaseous samples, and a laser ionization method for solid samples.

The ion trap 3 is a three-dimensional quadrupole ion trap composed of a circular ring electrode 31 and a pair of end-cap electrodes 32 and 34 opposing each other across the ring electrode 31. An ion inlet 33 is bored approximately at the center of the entrance-side end-cap electrode 32, while an ion outlet 35 is bored approximately at the center of the exit-side end-cap electrode 34 in substantial alignment with the ion inlet 33.

The TOFMS unit 4 includes a flight space 41, in which a reflectron 42 composed of a plurality of plate electrodes is provided, and an ion detector 43. A voltage applied from a direct-current voltage generator (not shown) to the reflectron 42 creates an electric field, by which incident ions are reflected backward and eventually detected by the ion detector 43.

The ion-trap drive unit 5 applies a voltage to each of the electrodes 31, 32 and 34 forming the ion trap 3. It includes a drive signal generator 51, a ring voltage generator 52 and an end-cap voltage generator 53. As will be explained later, the ring voltage generator 52 produces a rectangular-wave voltage of a predetermined frequency and amplitude based on a drive signal supplied from the drive signal generator 51 and applies it to the ring electrode 31. The end-cap electrode generator 53, which also operates on the basis of the drive signal supplied from the drive signal generator 51, applies a predetermined direct-current voltage to each of the end-cap electrodes 32 and 34 when the ions are ejected from the ion trap 3 to the TOFMS unit 4. In some operations, such as the selection of a precursor ion, the end-cap voltage generator 53 also generates a frequency division signal synchronized with the rectangular-wave voltage applied to the ring electrode 31 and applies it to the end-cap electrodes 32 and 34. Such controls are not essential for the present invention and will not be described in this specification. Detailed information is available, for example, in Non-Patent Document 1.

A gas introduction unit 6 having a valve and other components selectively introduces cooling gas or collision-induced dissociation (CID) gas into the ion trap 3. The cooling gas is a gas that will neither be ionized nor dissociated when colliding with an ion chosen as the target of the measurement. Typical examples include helium, argon, nitrogen and other kinds of inert gas.

The operations of the ionization unit 1, TOFMS unit 4, ion-trap drive unit 5, gas introduction unit 6 and other components are controlled by a controller 7 consisting of a central processing unit (CPU) and other elements. The controller 7 is equipped with an operation unit 8 for allowing users to set analysis conditions or other kinds of information.

Figure 2:
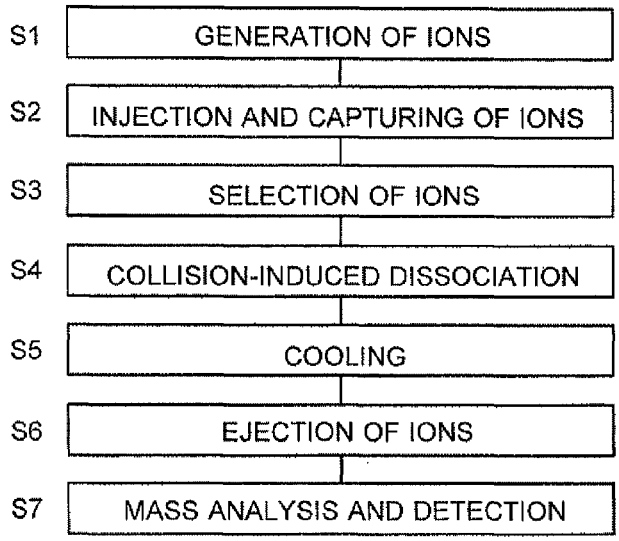
FIG. 2 is a flowchart showing one example of the procedure of a mass analysis using the IT-TOFMS of the present embodiment.

FIG. 2 is a flowchart showing the process steps of an MS/MS analysis performed by the IT-TOFMS of the present embodiment. The basic operation of the MS/MS analysis is hereinafter described according to FIG. 2.

The ionization unit 1 turns the molecules or atoms of the components of a target sample into ions by a predetermined ionization method (Step S1). These ions are transported by the ion guide 2, to be introduced through the ion inlet 33 into the ion trap 3 and captured therein (Step S2). Normally, when the ions are introduced into the ion trap 3, two direct-current voltages are respectively applied from the end-cap voltage generator 53 to the two end-cap electrodes 32 and 34 in such a manner that the voltage applied to the entrance-side end-cap electrode 32 draws ions into the ion trap 3 while the voltage applied to the exit-side end-cap electrode 34 repels the ions that have entered the ion trap 3.

For an ionization unit 1 that produces ions in a pulsed form as in the case of the matrix-assisted laser desorption ionization (MALDI), a rectangular-wave voltage is applied to the ring electrode 31 immediately after a packet of incident ions is drawn into the ion trap 3, so as to create an ion-capturing electric field and capture the introduced ions. For an ionization unit 1 that almost continuously produces ions (as in the case of the atmospheric pressure ionization), a resistive coating is formed on a portion of the rod electrodes of the ion guide 2 to create a depression of the potential at the end portion of the ion guide 2 so that the ions can be temporarily stored in the depression and then injected into the ion trap 3 in a temporally compressed form.

After the ions are stored in the ion trap 3, unnecessary ions are removed from the ion trap 3 so that only the ions having a specific mass-to-charge ratio are left in the ion trap 3 as the precursor ion (Step S3). This is achieved, for example, by changing the duty ratio of the rectangular-wave voltage applied from the ion-trap drive unit 5 to the ring electrode 31, or by varying the frequency of the rectangular-wave signal for resonant ejection applied to the end-cap electrodes 32 and 34 over a certain range.

Subsequently, a CID gas is introduced from the gas introduction unit 6 into the ion trap 3, and a rectangular-wave voltage of small amplitude, whose frequency corresponds to the mass-to-charge ratio of the precursor ion, is applied to the end-cap electrodes 32 and 34. By this operation, an amount of kinetic energy is given to the precursor ion, causing this ion to be excited and collide with the CID gas, whereby the ion is dissociated into product ions (Step S4). The created product ions are also captured by the capturing electric field created by the rectangular-wave voltage applied to the ring electrode 31.

Subsequently, cooling gas is introduced from the gas introduction unit 6 into the ion trap 3 to cool the ions, while maintaining the ions in the trapped state by a capturing electric field created by applying a rectangular-wave high voltage of a predetermined frequency and amplitude to the ring electrode 31 (Step S5). After the cooling is continued for a predetermined period of time, a direct-current high voltage is applied between the end-cap electrodes 32 and 34 to give an amount of kinetic energy to the ions so as to eject them from the ion outlet 35 into the TOFMS unit 4 (Step S6). Among the ions accelerated by the same accelerating voltage, an ion having a smaller mass-to-charge ratio flies faster and arrives at, and is detected by, the ion detector 43 earlier (Step S7). The detection signal produced by the ion detector 43 is recorded with the lapse of time from the point of the ejection of the ions from the ion trap 3 to obtain a time-of-flight spectrum showing the relationship between the time of flight and the intensity of the ion. Since the time of flight corresponds to the mass-to-charge ratio, it is possible to create an MS/MS spectrum by converting the time of flight to the mass-to-charge ratio.

In the case of a normal mass analysis with no dissociation of the ions, it is possible to omit the processes of Steps S3 and S4. In the case of performing an $MS^3$ or higher-order analysis including a multi-stage dissociation, the processes of Steps S3 through S4 (or S5) can be repeated a desired number of times.

An operation characteristic of the IT-TOFMS of the present embodiment is hereinafter described. A major difference from the conventional case exists in the cooling process of Step S5. In the conventional cooling process, a rectangular-wave voltage having the same frequency and amplitude is applied to the ring electrode 31 until immediately before the ejection of the ions to confine the ion within the smallest possible space around the center of the ion trap 3. By contrast, in the IT-TOFMS of the present embodiment, the controller 7 operates the ion-trap drive unit 5 so that the frequency of the rectangular-wave voltage applied to the ring electrode 31 is increased from the previous level at the final stage of the cooling process, i.e. for a predetermined period of time immediately before the ejection of the ions.

Figure 3A:
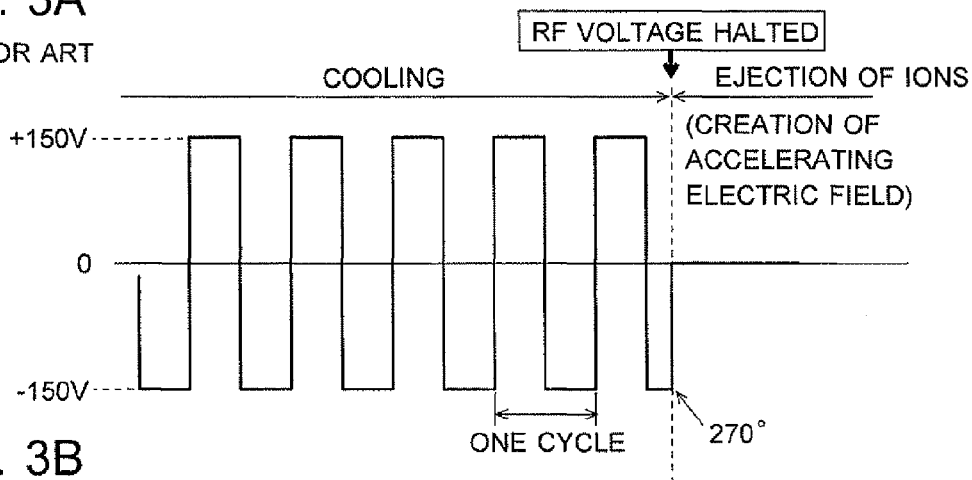
Fig. 3A PRIOR ART
FIG. 3A is a schematic waveform diagram of a rectangular-wave voltage applied to the ring electrode before and after the ejection of the ions in a conventional IT-TOFMS.
Figure 3B:
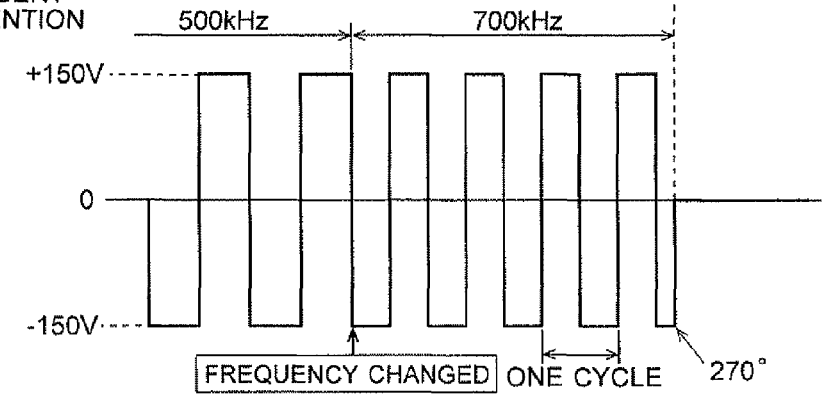
FIG. 3B is the same diagram for the IT-TOFMS of the present embodiment.

FIG. 3A is a schematic waveform diagram of a rectangular-wave voltage applied to the ring electrode before and after the ejection of the ions in a conventional IT-TOFMS, and FIG. 3B is the same diagram for the IT-TOFMS of the present embodiment.

In the present example, a rectangular-wave voltage 2 of ±150 V (300 Vp-p) in amplitude and 500 kHz in frequency is applied to the ring electrode 31 to create a capturing electric field in the cooling process. In the conventional case, as shown in FIG. 3A, this rectangular-wave voltage is continuously applied until immediately before the ejection of the ions. The application of the rectangular-wave voltage is halted at a phase position of $(3/2)\pi$ (=270°) within one cycle of the rectangular-wave voltage, in place of which a direct-current voltage is applied between the end-cap electrodes 32 and 34 to eject ions from the ion trap 3.

The merits obtained by halting the application of the rectangular-wave voltage at a phase position of $(3/2)\pi$ (=270°) within one cycle of the rectangular-wave voltage to eject ions are described in Patent Document 3 and will not be explained in this specification.

Figure 4:
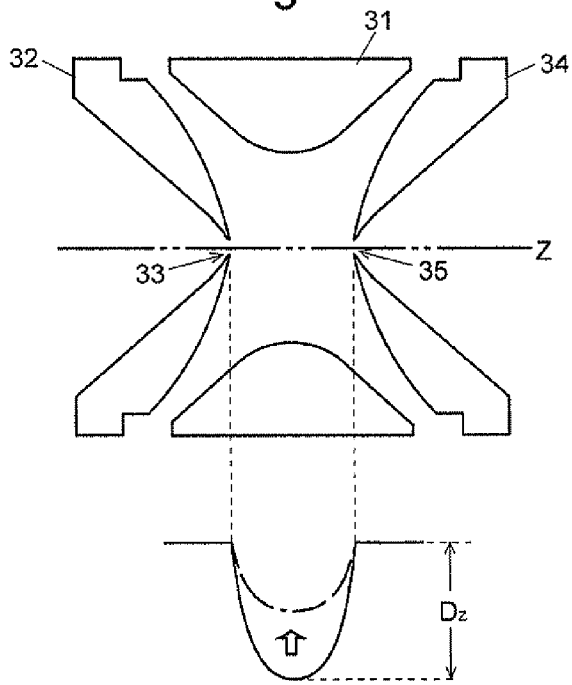
FIG. 4 is a conceptual diagram showing the shape of a potential within the ion trap immediately before the ejection of the ions in the IT-TOFMS of the present embodiment.

In the IT-TOFMS of the present invention, as shown in FIG. 3B, the frequency of the rectangular-wave voltage is increased from 500 kHz to 700 kHz, with no change in the amplitude, for a period of 4 to 5 cycles immediately before the rectangular-wave voltage is halted. The switching of the frequency can be almost instantaneously completed since it merely requires changing the control signal of a semiconductor switch for selecting one of the two voltage levels (+150 V and −150 V). As previously shown in equation (2), the depth of confining potential is inversely proportional to the square of the angular frequency of the rectangular-wave voltage. Accordingly, the increase in the frequency from 500 kHz to 700 kHz causes the potential depth to decrease to approximately one half. As illustrated in FIG. 4, the rectangular-wave voltage applied to the ring electrode 31 creates a potential well of depth Dz along the Z axis in the ion trap 3, and ions oscillate at the bottom of this well. The aforementioned decrease in the potential depth to one half means that the potential well becomes shallower.

Figure 5:
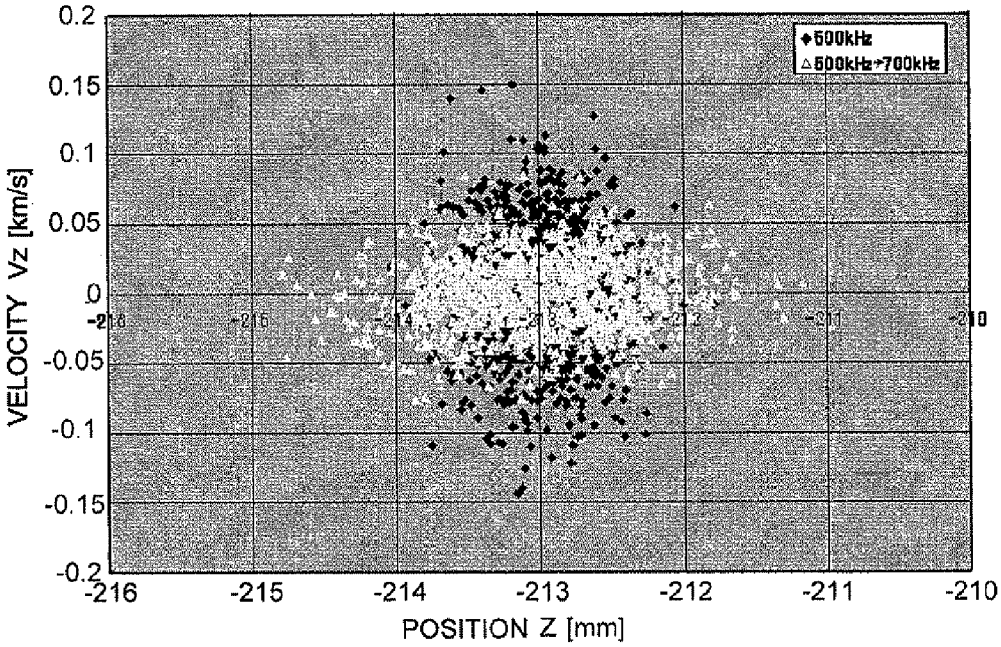
FIG. 5 is a chart showing the result of a simulation of the relationship between the positional distribution and velocity distribution of the ions at the timing of cutting the rectangular-wave voltage in the cases where rectangular-wave voltages having the waveforms shown in FIGS. 3A and 3B are respectively applied.

When the potential well becomes shallower, its ion-capturing force becomes accordingly weaker. As a result, the kinetic energy of the oscillating ions, or the speed of the ions, becomes lower. Therefore, the speed of the ions at the moment of the halting of the rectangular-wave voltage and the creation of the accelerating electric field for ion ejection is lower than in the conventional case, so that the turn-around time will be shorter. However, the weakening of the capturing force not only decelerates the ions but also makes the ions spatially spread more easily. FIG. 5 shows the result of a simulation of the relationship between the positional distribution (horizontal axis) and velocity distribution (vertical axis) of ions at the timing of halting the rectangular-wave voltage in the case where rectangular-wave voltages having the waveforms shown in FIGS. 3A and 3B are respectively applied.

FIG. 5 demonstrates that the increase in the frequency of the rectangular-wave voltage from 500 kHz to 700 kHz causes the positional distribution of the ions to be broader and their velocity distribution (i.e. the distribution of the kinetic energy) to be narrower than in the case where the frequency is maintained at 500 kHz. The spatial spread of the ions makes a variation in their initial potential energy at the moment of ejection. However, this variation in the potential energy will not lead to a variation in the time of flight if it is small enough to be corrected by the reflectron 42 of the TOFMS unit 4. By contrast, the variation in the initial velocity of the ions (i.e. the spread of their initial kinetic energy) is more problematic since it leads to an increase in the turn-around time, which cannot be corrected by the TOFMS unit 4. These facts suggest that the mass-resolving power of the TOFMS unit 4 can be improved by narrowing the velocity distribution of the ions while allowing them to spatially spread to some extent. In the present example, the positional distribution is approximately ±2 mm. A distribution of the initial potential energy due to such a small positional distribution can be sufficiently corrected by the reflectron 42 of the TOFMS unit 4. Therefore, although the positional distribution of the ions is spread, its influence will not become explicit, so that it is possible to fully obtain the effect of the improvement in the mass-resolving power due to the shortened turn-around time achieved by narrowing the velocity distribution of the ions.

Figure 6A:
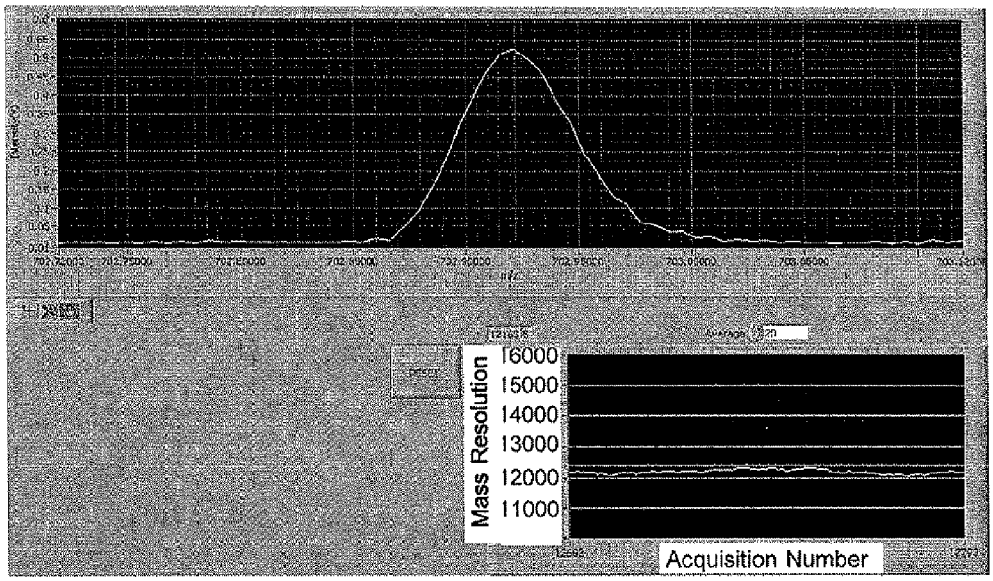
FIGS. 6A and 6B show mass profiles for m/z702 obtained by actual measurements in which rectangular-wave voltages having the waveforms shown in FIGS. 3A and 3B were respectively applied.
Figure 6B:
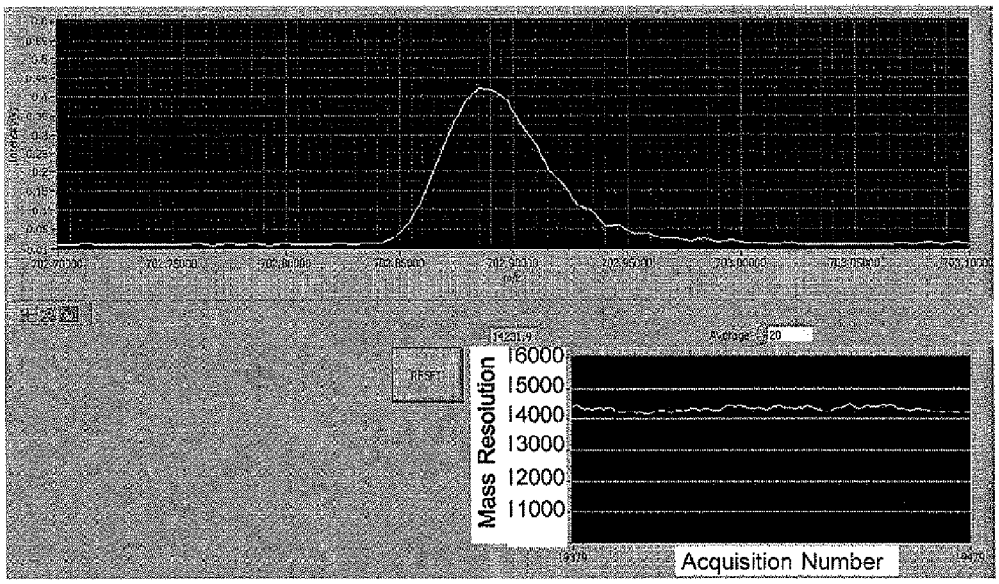

To verify the effect of the improvement in the mass-resolving power in the IT-TOFMS of the present embodiment, a mass profile for m/z702 was measured under each of the two conditions illustrated in FIGS. 3A and 3B, and the mass-resolving power was calculated for each case. FIGS. 6A and 6B show the results. In each of these figures, the upper chart is the waveform of the measured mass profile, while the lower chart shows the relationship between the mass resolution and the number of acquired ions, As shown in FIG. 6A, the mass resolution in the conventional case was near 12,000, whereas the mass resolution in the present embodiment was higher than 14,000. The improvement in the mass-resolving power can also be confirmed by comparing the waveforms of the two mass profiles; the peak of the present embodiment is evidently narrower than that of the conventional case.

As already noted, increasing the frequency of the rectangular-wave voltage has not only the advantage of decreasing the speed of the ions but also the disadvantage of spreading the positional distribution of the ions. When the period of time for increasing the frequency is too long, the initial position of the ions will be too spread out, so that the energy variation of the ions due to their positional spread cannot be corrected by the TOFMS unit 4. In such a situation, the expected effect will not be obtained since the improvement in the mass-resolving power due to the shortened turn-around time will be totally cancelled by the deterioration in the mass-resolving power due to the energy variation. Setting too short a period of time for increasing the frequency of the rectangular-wave voltage should also be avoided since it will lead to insufficient deceleration of the ions for obtaining the expected effect. Accordingly, the period of time for increasing the frequency of the rectangular-wave voltage should be set within an appropriate range.

Figure 7:
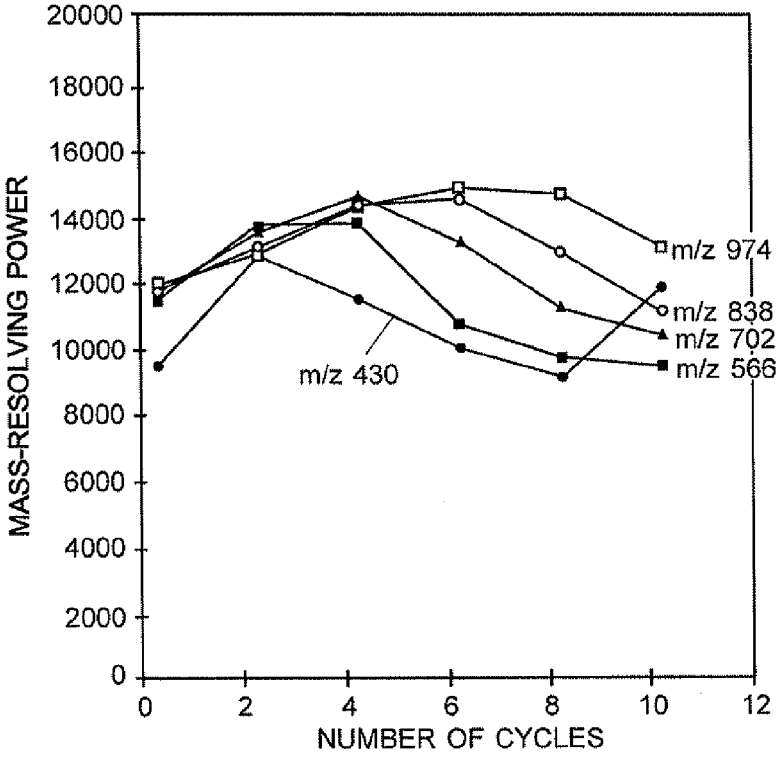
FIG. 7 shows the relationship between the number of cycles for increasing the the frequency of the rectangular-wave voltage and the mass-resolving power based on the result of an actual measurement.

FIG. 7 shows the result of a measurement of the relationship between the mass-resolving power and the period of time during which the frequency of the rectangular-wave voltage was increased to 700 kHz. (The period of time is expressed in terms of the number of cycles of the voltage waves.) The mass-to-charge ratio of the target ion is also regarded as a parameter since the degree of influence of the potential on an ion varies depending on its mass-to-charge ratio. The result shows that the mass-resolving power depends on the number of cycles (and hence the period of time with the increased frequency) and also on the mass-to-charge ratio. The plotted data show, with some exceptions, the general tendency that the optimal number of cycles for achieving the highest mass-resolving power decreases as the mass-to-charge ratio decreases. This is probably because an ion having a smaller mass-to-charge ratio moves at a higher speed and hence undergoes a greater amount of increase in the positional distribution with the decrease of the potential depth. The obtained result demonstrates that the period of time for increasing the frequency of the rectangular-wave voltage should be appropriately set to achieve a high mass-resolving power. It also suggests that the period of time for increasing the frequency of the rectangular-wave voltage should be changed according to the value or range of the mass-to-charge ratio of the ion to be analyzed. (Specifically, a longer period of time should be set for a larger mass-to-charge ratio.)

In practice, the appropriate length of time (number of cycles) for increasing the frequency of the rectangular-wave voltage depends on not only the mass-to-charge ratio of the ion but also many other factors, such as the amplitude of the rectangular-wave voltage, the cooling conditions in the ion trap 3 (e.g. the kind of cooling gas and the gas pressure), and the range of energy distribution that can be corrected by the TOFMS unit 4. Therefore, it is necessary to select beforehand an appropriate number of cycles according to these conditions or appropriately change the number of cycles in response to a change in or setting of the conditions. The results of the previously described simulation and measurement performed for the present embodiment suggest that, in the case where the potential depth is decreased to approximately one half, the improvement in the mass-resolving power due to the shortening of the turn-around time will take effect if the aforementioned length of time is within a range that approximately corresponds to one to ten cycles of the rectangular-wave voltage.

While the length of the cooling process is normally within a range from 10 to 100 msec, the period for increasing the frequency of the rectangular-wave voltage is within a range from one to a dozen μsec. That is to say, the period with the increased frequency occupies only a fraction of the entire cooling process.

Figure 8:
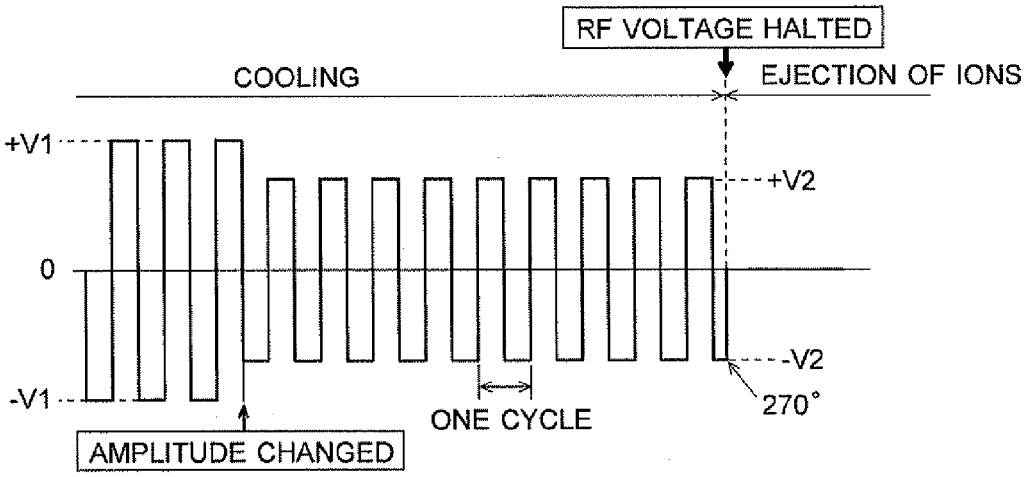
FIG. 8 is a schematic waveform diagram of a rectangular-wave voltage applied to the ring electrode before and after the ejection of the ions in an IT-TOFMS in accordance with another embodiment of the present invention.

Equation (2) suggests that a reduction in the depth of confining potential $\phi$ can also be achieved by decreasing the amplitude V of the rectangular-wave voltage applied to the ring electrode 31. In this case, the timing chart of the rectangular-wave voltage before and after the ejection of the ions will be as shown in FIG. 8. The depth of the confining potential is proportional to the square of the amplitude of the rectangular-wave voltage. Therefore, to decrease the potential depth to approximately one half as in the previous embodiment, the amplitude V2 after the switching should be set to approximately 0.70 to 0.71 times the previous amplitude V1. By this switching operation, similar to the previous embodiment, the depth of confining potential is decreased at the final stage immediately before the ejection of the ions, whereby the ions are decelerated and their turn-around time is shortened. The factors to be considered in setting an appropriate period of time (or number of cycles) for decreasing the amplitude, and the advantage of changing the period of time according to the mass-to-charge ratio, are the same as described in the previous embodiment.

It should be noted that the previous embodiments are mere examples of the present invention, and any change, addition or modification appropriately made within the spirit of the present invention will naturally fall within the scope of claims of the present patent application.

For example, although the ion trap used in the previous embodiments was a three-dimensional quadrupole type, it is possible to apply the present invention to an ion trap time-of-flight mass spectrometer using a linear ion trap to obtain the same effects as obtained by using the three-dimensional quadrupole ion trap.

EXPLANATION OF NUMERALS

1 . . . Ionization Unit
2 . . . Ion Guide
3 . . . Ion Trap
31 . . . Ring Electrode
32 . . . Entrance-Side End-Cap Electrode
33 . . . Ion Inlet
34 . . . Exit-Side End-Cap Electrode
35 . . . Ion Outlet
4 . . . Time-of-Flight Mass Spectrometer Unit (TOFMS)
41 . . . Flight Space
42 . . . Reflectron
43 . . . Ion Detector
5 . . . Ion-Trap Drive Unit
51 . . . Drive Signal Generator
52 . . . Ring Voltage Generator
53 . . . End-Cap Voltage Generator
6 . . . Gas Introduction Unit
7 . . . Controller
8 . . . Operation Unit

The invention claimed is:

1. An ion trap time-of-flight mass spectrometer including an ion trap composed of a plurality of electrodes and a time-of-flight mass spectrometer unit for performing a mass analysis of ions ejected from the ion trap, the mass spectrometer being constructed to temporarily capture ions to be analyzed in the ion trap, subject the ions to a cooling process in which a kinetic energy of the ions is attenuated by making the ions come in contact with a cooling gas, and create an accelerating electric field in the ion trap so as to collectively eject the ions from the ion trap into the time-of-flight mass spectrometer unit and make the ions undergo an analysis, comprising:

a) a voltage applier for applying an ion-capturing radio-frequency rectangular-wave voltage to at least one of the electrodes; and b) a controller for operating the voltage applier so as to apply a radio-frequency rectangular-wave voltage to the aforementioned at least one of the electrodes during the cooling process, wherein the controller operates the voltage applier in such a manner that a rectangular-wave voltage having a predetermined frequency and a predetermined amplitude is applied to the aforementioned at least one of the electrodes so as to capture the ions with a potential having a predetermined depth, and then the frequency of the rectangular-wave voltage is increased so as to reduce the depth of the potential for a predetermined period of time immediately before the ions are ejected.

2. The ion trap time-of-flight mass spectrometer according to claim 1, wherein a length of the predetermined period of time is set so that a spatial spread of the ions due to the reduction in the depth of the potential will fall within a range that can be corrected by an energy-focusing function of the time-of-flight mass spectrometer unit.

3. The ion trap time-of-flight mass spectrometer according to claim 2, wherein an amount of increase in the frequency of the rectangular-wave voltage is determined so that the depth of the potential will be one half of a previous level.

4. The ion trap time-of-flight mass spectrometer according to claim 3, wherein the length of the predetermined period of time is set within a temporal range corresponding to approximately one to ten times a cycle of the rectangular-wave voltage.

5. The ion trap time-of-flight mass spectrometer according to claim 4 wherein the controller changes the length of the predetermined period of time according to the mass-to-charge ratio of an ion to be analyzed.

6. The ion trap time-of-flight mass spectrometer according to claim 3, wherein the controller changes the length of the predetermined period of time according to the mass-to-charge ratio of an ion to be analyzed.

7. The ion trap time-of-flight mass spectrometer according to claim 2, wherein the controller changes the length of the predetermined period of time according to the mass-to-charge ratio of an ion to be analyzed.

8. An ion trap time-of-flight mass spectrometer including an ion trap composed of a plurality of electrodes and a time-of-flight mass spectrometer unit for performing a mass analysis of ions ejected from the ion trap, the mass spectrometer being constructed to temporarily capture ions to be analyzed in the ion trap, subject the ions to a cooling process in which a kinetic energy of the ions is attenuated by making the ions come in contact with a cooling gas, and create an accelerating electric field within the ion trap to collectively eject the ions from the ion trap into the time-of-flight mass spectrometer unit and make the ions undergo an analysis, comprising:

a) a voltage applier for applying an ion-capturing radio-frequency rectangular-wave voltage to at least one of the electrodes; and b) a controller for operating the voltage applier so as to apply a radio-frequency rectangular-wave voltage to the aforementioned at least one of the electrodes during the cooling process, wherein the controller operates the voltage applier in such a manner that a rectangular-wave voltage having a predetermined frequency and a predetermined amplitude is applied to the aforementioned at least one of the electrodes so as to capture the ions with a potential having a predetermined depth, and then the amplitude of the rectangular-wave voltage is decreased so as to reduce the depth of the potential for a predetermined period of time immediately before the ions are ejected.

9. The ion trap time-of-flight mass spectrometer according to claim 8, wherein a length of the predetermined period of time is set so that a spatial spread of the ions due to the reduction in the depth of the potential will fall within a range that can be corrected by an energy-focusing function of the time-of-flight mass spectrometer unit.

10. The ion trap time-of-flight mass spectrometer according to claim 9, wherein an amount of decrease in the amplitude of the rectangular-wave voltage is determined so that the depth of the potential will be one half of a previous level.

11. The ion trap time-of-flight mass spectrometer according to claim 10, wherein the length of the predetermined period of time is set within a temporal range corresponding to approximately one to ten times a cycle of the rectangular-wave voltage.

12. The ion trap time-of-flight mass spectrometer according to claim 11, wherein the controller changes the length of the predetermined period of time according to the mass-to-charge ratio of an ion to be analyzed.

13. The ion trap time-of-flight mass spectrometer according to claim 10, wherein the controller changes the length of the predetermined period of time according to the mass-to-charge ratio of an ion to be analyzed.

14. The ion trap time-of-flight mass spectrometer according to claim 9, wherein the controller changes the length of the predetermined period of time according to the mass-to-charge ratio of an ion to be analyzed.

* * * * *